US005252063A

United States Patent [19]

Thillen et al.

[11] Patent Number: 5,252,063

[45] Date of Patent: Oct. 12, 1993

[54] COOLING DEVICE FOR THE DISTRIBUTION CHUTE OF AN INSTALLATION FOR CHARGING A SHAFT FURNACE

[75] Inventors: Guy Thillen, Diekirch; Radomir Andonov, Mamer; Emile Lonardi, Bascharage, all of Luxembourg

[73] Assignee: Paul Wurth S.A., Luxembourg

[21] Appl. No.: 898,790

[22] Filed: Jun. 12, 1992

[30] Foreign Application Priority Data

Jun. 12, 1991 [LU] Luxembourg ..... 87948

[51] Int. Cl.[5] ..... F27D 1/12

[52] U.S. Cl. ..... 432/235; 432/238; 432/99

[58] Field of Search ..... 432/233, 238, 99, 235; 266/183

[56] References Cited

U.S. PATENT DOCUMENTS 4,332,554 6/1982 Van Laar et al. ..... 432/233
4,358,094 11/1982 Megerle et al. ..... 432/238
4,526,536 7/1985 Legille et al. ..... 432/238
4,638,492 1/1987 Kerr ..... 432/238
4,941,824 7/1990 Holter et al. ..... 432/233

*Primary Examiner*—Henry C. Yuen
*Attorney, Agent, or Firm*—Fishman, Dionne & Cantor

[57] ABSTRACT

A device is proposed for cooling the distribution chute of an installation for charging a shaft furnace. This installation comprises a feed channel, a rotary collar and a rotary cage, a fixed outer housing, a distribution chute mounted in a pivoting manner in the rotary cage, a driving means so as to cause the collar and the cage to turn, as one about the vertical axis of the channel and two drive casings acting on suspension shafts of the chute so as to pivot about a horizontal axis. An annular tank for feeding with cooling fluid is secured to the upper edge of the rotary collar. The distribution chute comprises a circuit for cooling the lower surface of its body and is connected directly, through channels passing axially through the suspension shafts of the chute and rotary connectors to the annular tank.

19 Claims, 13 Drawing Sheets

Fig. 6
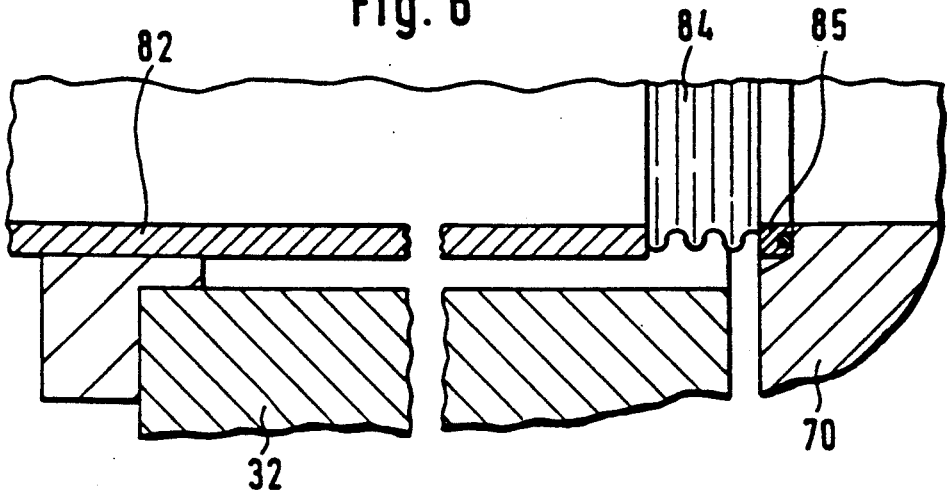
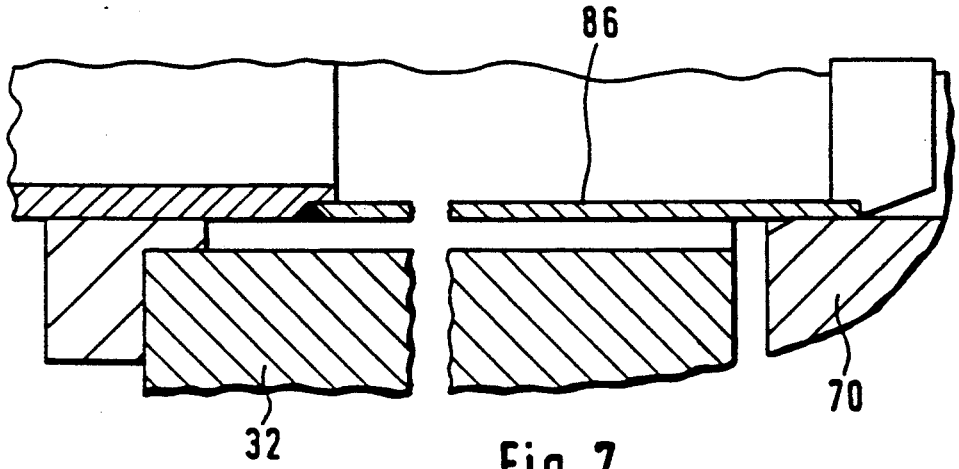
Fig. 7

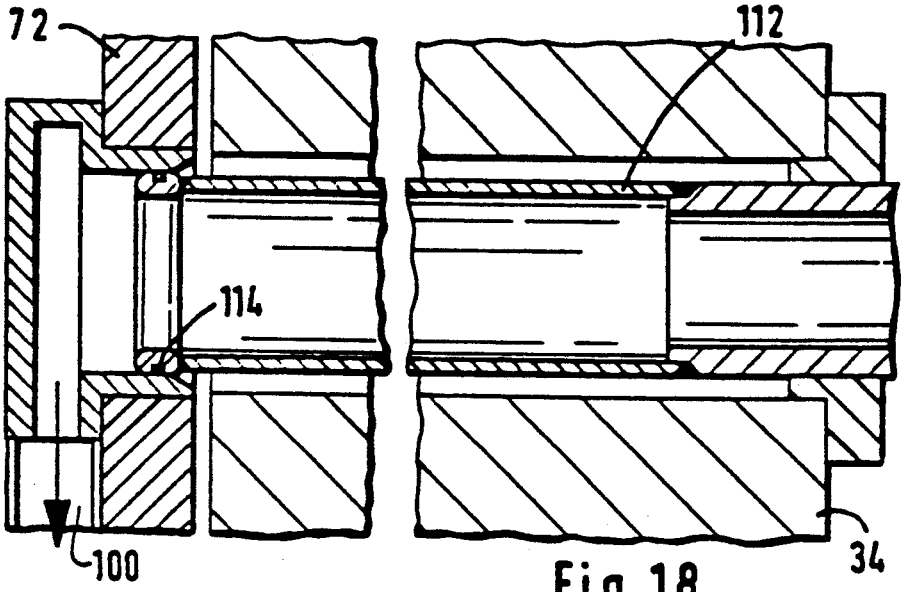
Fig.18
Fig.19
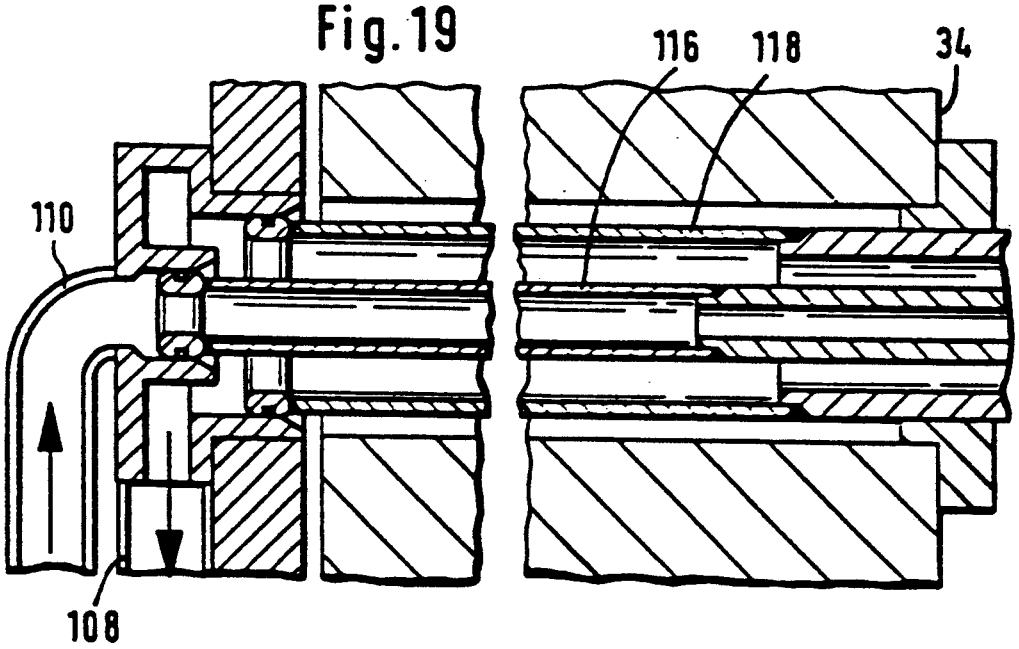

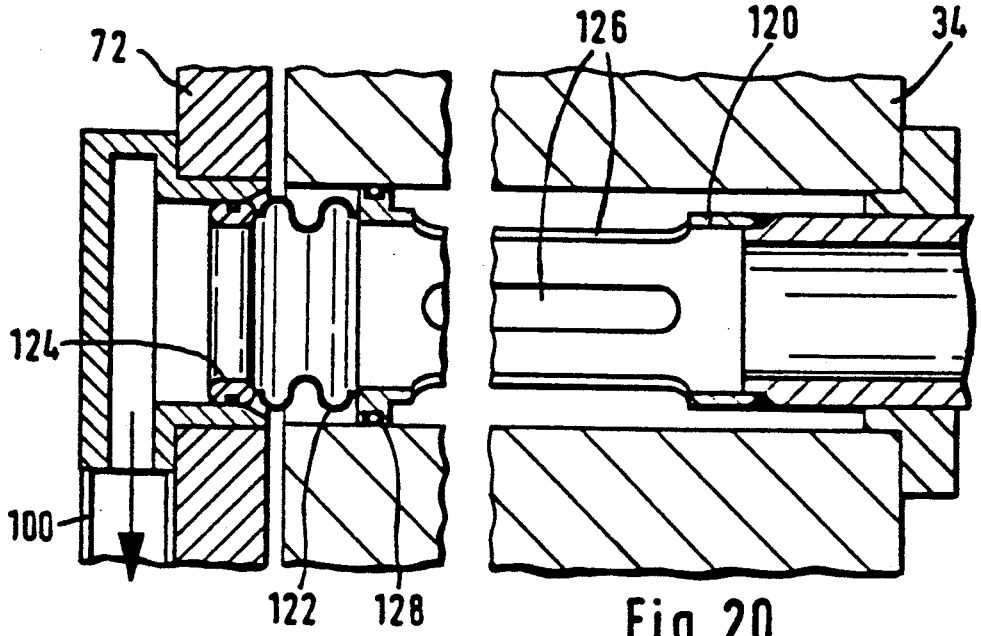
Fig. 20
Fig. 21
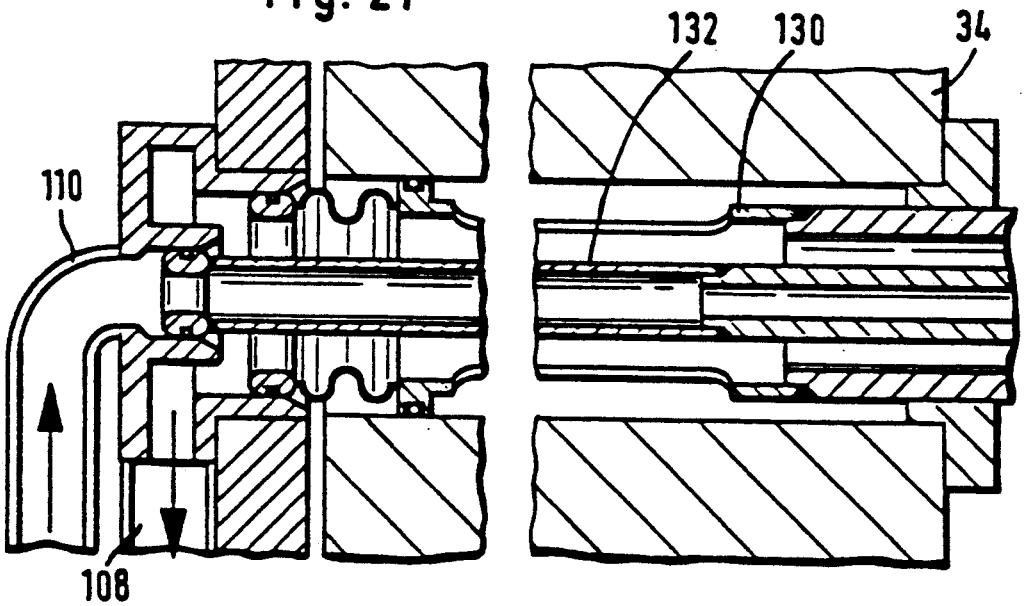

COOLING DEVICE FOR THE DISTRIBUTION CHUTE OF AN INSTALLATION FOR CHARGING A SHAFT FURNACE

BACKGROUND OF THE INVENTION

The present invention relates to a device for cooling the distribution chute of an installation for charging a shaft furnace, comprising a fixed feed channel disposed vertically in the center of the head of the furnace, a rotary collar mounted coaxially around the feed channel, a fixed outer casing mounted coaxially on the outside of the collar and delimiting laterally with the latter a substantially annular chamber, this chamber being separated from the inside of the furnace by means of a cage securely attached to the rotary collar, a distribution chute mounted in a pivoting manner in the rotary cage, a driving means for causing the collar and the cage to turn, as one, around the vertical axis of the furnace and of the feed channel, two drive casings disposed diametrically opposed in the chamber and rotating with the rotary cage about the vertical axis, these casings acting on the suspension shafts of the chute so as to cause the pivoting of the latter, an annular feed tank secured to the upper edge of the rotary collar and whose outer and inner concentric walls slide in an upper fixed plate through which passes at least one pipe for admission of a cooling fluid feeding the annular tank.

A charging installation of this kind is described in U.S. Pat. No. 3,880,302, incorporated herein by reference, which is directed to bell-less charging installations, currently the most widely used type of charging installation in the world. This type of apparatus is best suited for the extremely difficult conditions in which such an installation must operate, particularly because of the high temperatures and because of the atmosphere laden with corrosive and abrasive dust.

In order to relieve the worst affected parts from these extreme conditions, an uncontrolled circulation of an inert gas under pressure and cooled in the annular chamber was initially provided in charging installations of this kind. This circulation possesses a double function, namely cooling the immersed parts by the cooling gas and preventing abrasive dust from entering the annular chamber because of the flow of inert gas towards the inside of the furnace through the labyrinths separating the fixed members from the rotary members.

More recently, U.S. Pat. No. 4,526,536, incorporated herein by reference, proposes replacing the system of cooling by uncontrolled immersion in an inert gas with a water cooling system consisting in cooling, in particular, the rotary cage by means of cooling coils. This cooling directly protects the wall of the rotary cage and reduces transmission, either by conduction or by radiation, of the heat to other parts, such as the bearings and gears for example.

Heretofore, no provision has been made also to cool the distribution chute. One of the reasons is that there has not been a pressing need for cooling of the chute, given that the operational temperatures of the upper parts of furnaces and the above-mentioned systems for cooling the drive device permitted satisfactory operation of the chute without necessitating direct cooling. However, the situation has changed in recent times through implementation of the powered coal injection processes, replacing the conventional oil-derived fuels. The use of these solid fuels results in a rise of the temperature in the central region of the furnace, with peaks which may exceed 1,000° C. above the charging surface. These high temperatures reduce the strength of the anti-wear plates for protection of the chute, which results in an increase in the frequency of maintenance and of replacement and in a reduction in the mechanical strength of the chute.

Indeed, U.K. Patent GB-1,487,527, incorporated herein by reference, proposes a distribution chute having a double walled intended for a cooling system. This cooling system proposal was one for cooling by immersion, by connecting the chute cooling circuit through the chute suspension shafts to the annular chamber into which the inert gas was injected, with the aim that the cooling gas could spread as far as the inside of the chute. However, this proposal does not provide an effective cooling of the chute given that the inert gas penetrates only in a random manner into the chute cooling circuit, subject to the resistance which is offered to its passage. As it is, in order to be effective, the pressure of the inert gas inside the casing ought to be increased, but such an increase in the pressure would cause substantial leaks of gas through the labyrinths provided in order to contain it, and lead therefore, to an excessive consumption of gas.

SUMMARY OF THE INVENTION

An object of the present invention is to provide a controlled and channeled cooling of a distribution chute in an installation of the kind described above.

In order to attain this objective, the device of the Present invention is essentially characterized in that the distribution chute comprises a circuit for cooling the lower surface of its body, which is connected directly through pipes passing axially through the chute suspension shafts and rotary connectors to the annular tank.

According to a first embodiment, the cooling fluid is an inert gas, to which may possibly be added small quantities of water or water vapor so as to augment its thermal capacity.

The system for cooling the chute may be constituted by a double wall enveloping the lower surface of the body and divided by longitudinal partitions into individual compartments opening, at the end of the chute, towards the inside of the furnace.

The annular tank is, preferably, associated with an annular seal secured to the upper plate and penetrating inside the tank, the seal comprising inner and outer projecting ribs forming multiple labyrinths with the inner walls of the tank.

The present invention consequently provides well-aimed cooling by channeling the gas towards the places which it is desired to cool.

The passages through the chute suspension shafts may be constructed with the aid of a coaxial pipe securely attached to the shaft through which it passes, and connected to a side of the chute via a compensator and a frontal seal. This serves to compensate for a certain degree of freedom, necessary for expansion, between the chute and its suspension shafts. Instead of utilizing a compensator, it is also possible to use a thin, slightly deformable pipe.

It is also possible to use water as cooling fluid, which can enter the chute system through one of its suspension shafts and leave it through the opposite shaft.

The system for cooling the chute with water may comprise a U-shaped coil of piping buried longitudinally in a refractory layer provided around the lower surface of the chute, inside a metal jacket. Such a coil of piping may further comprise fins, for the exchange of heat, extending laterally on either side of the wall of all the coils of piping in the mass of the refractory layer. These fins may be provided, in the direction of the thickness, either between the coil of piping and the body of the chute, or between the coil of piping and the outer jacket, or in the middle of the coil of piping and of the refractory layer.

According to another embodiment, the system for cooling the chute comprises two separate U-shaped coils of piping extending longitudinally under the body of the chute and connected respectively to two coaxial inlet and outlet passages through each of the suspension shafts.

According to still another embodiment, the two U-shaped coils of piping are arranged coaxially with respect to the median longitudinal axis of the body and cooling water passes through them in the reverse direction. As in the case of the cooling by inert gas, the passages through the suspension shafts may be constructed by pipes with deformable walls or by bellows-type compensators in order to maintain a certain freedom of movement between the chute and its suspension shafts.

The above discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGS.:

FIG. 6 shows a first embodiment of a passage through a suspension shaft of the chute.

FIG. 7 shows diagrammatically a second embodiment of a passage through the suspension shaft of the chute.

FIGS. 18 and 20 show diagrammatically two embodiments of the cooling water passages through the chute suspension shafts.

FIGS. 19 and 21 show two embodiments having coaxial double passages for cooling water through the chute suspension shafts.

DESCRIPTION OF THE PREFERRED EMBODIMENT

Figure 1:
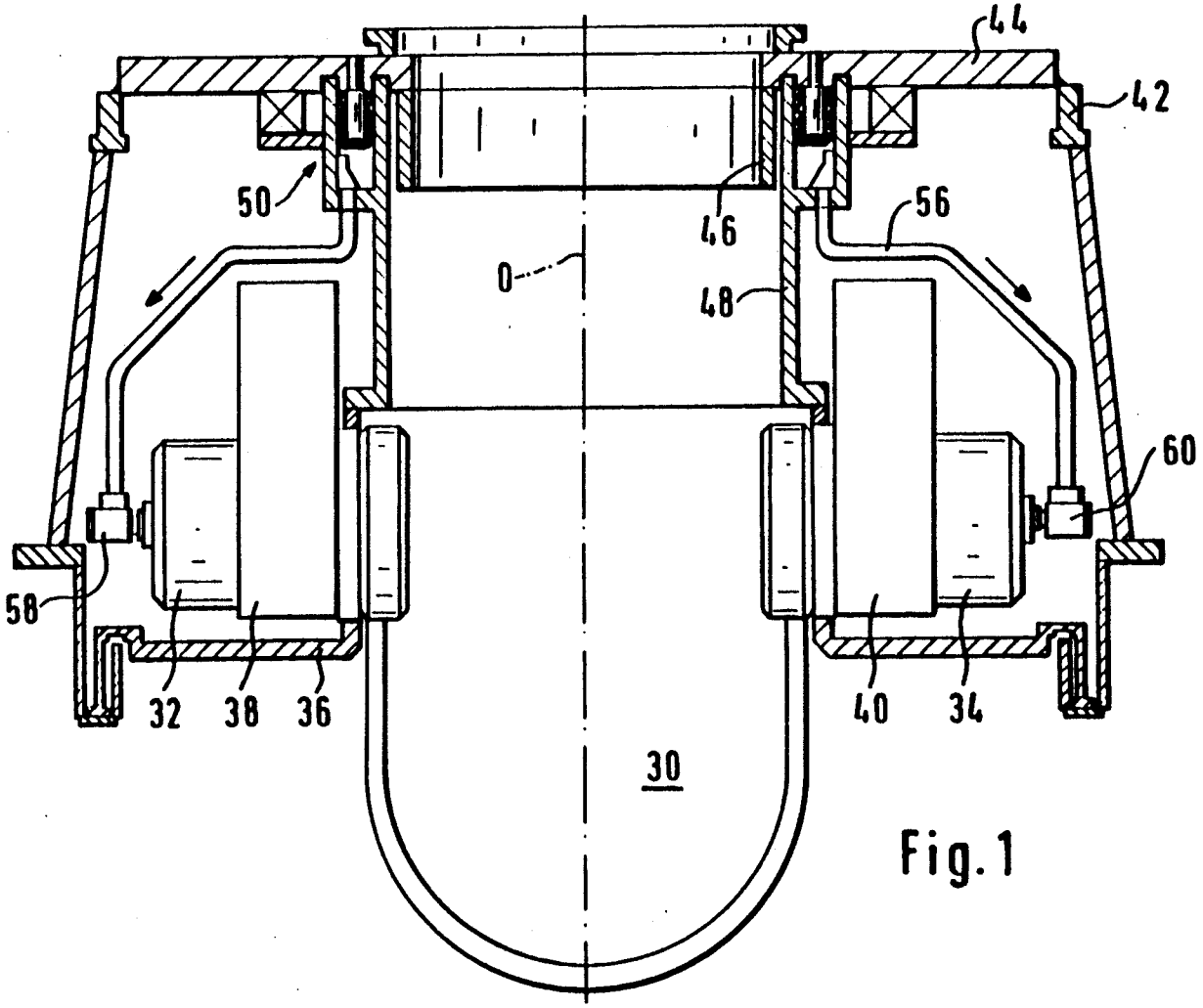
FIG. 1 shows diagrammatically a first embodiment of a device for cooling a chute by gas.

FIG. 1 shows the upper part of a distribution chute 30 whose drive and suspension mechanism is of the type described in the above-mentioned U.S. Pat. No. 3,880,302 and will therefore be only briefly described. The chute 30 is suspended by two suspension shafts 32, 34 so as to be capable of pivoting about the horizontal axis of the latter. These two shafts are housed in a rotary cage 36 with which they can rotate about the vertical axis 0 under the action of driving means not shown but described in greater detail in U.S. Pat. No. 3,880,302.

The pivoting of the chute 30 about its horizontal axis of suspension is produced by two casings 38, 40 gravitating with the cage 36 and the chute 30 about the vertical axis 0. The drive and suspension mechanism is contained in a leaktight housing 42 the upper plate 44 of which comprises an aperture with a channel 46 for admission of the charging material penetrating coaxially into a rotary collar 48 forming part of the cage 36.

Figure 2:
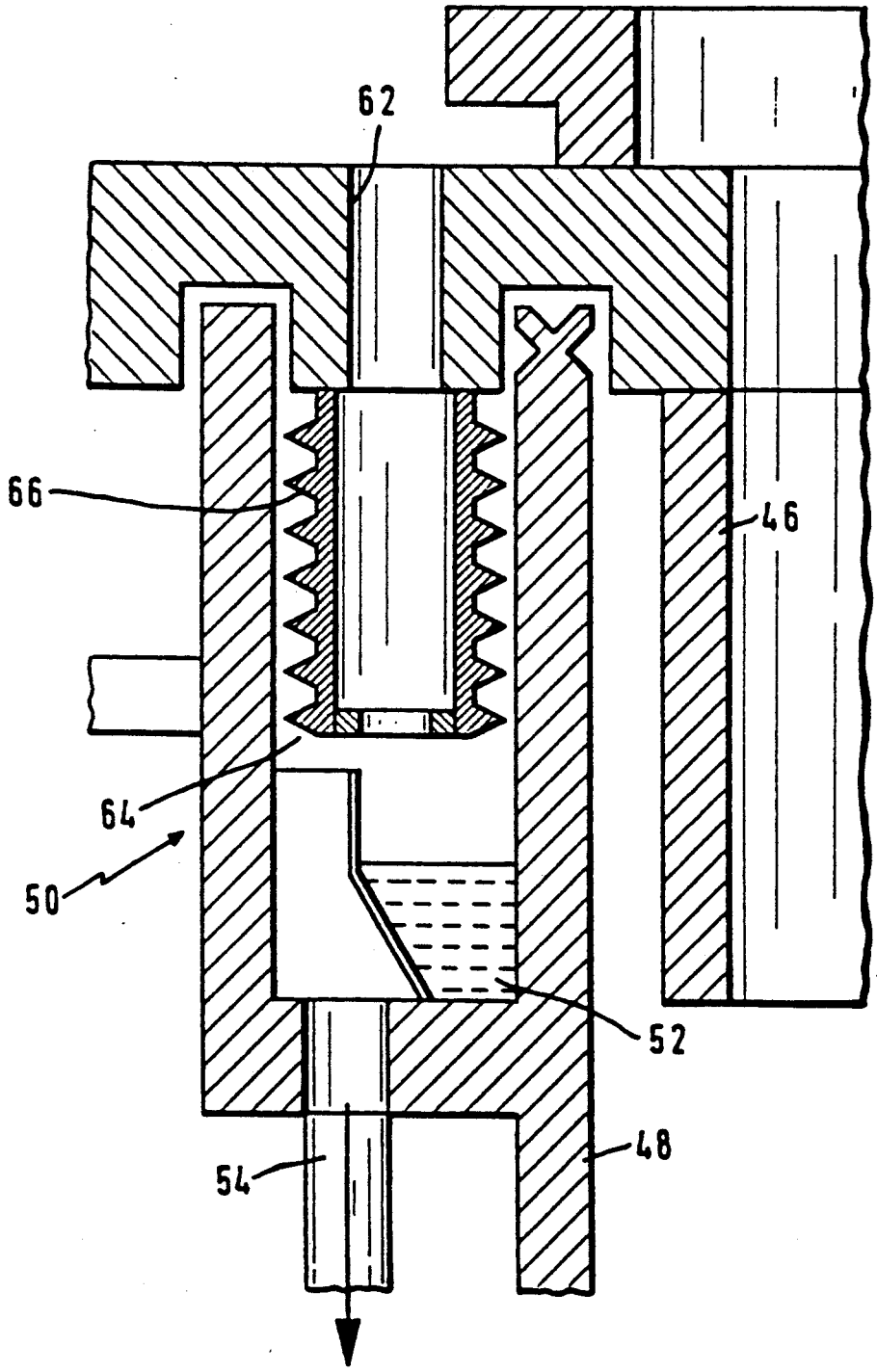
FIG. 2 shows diagrammatically a vertical cross-section through the annular feed tank.

Around the upper part of the collar 48 is arranged an annular tank 50 whose inner wall (formed by the collar 48) and outer wall slide in corresponding slots of the fixed plate 44. This tank 50, whose details are shown in FIG. 2, is a tank feeding cooling water to coils of piping (not shown) provided around the collar 48 and the rotary Cage 36, in accordance with U.S. Pat. No. 4,526,536. This cooling liquid 52 is in a compartment at the bottom of the annular tank 50.

According to the present invention, this tank 50 also serves as inlet for an inert gas for cooling. This cooling gas is sent via pipes 54, 56 (FIG. 1) to rotary connections 58, 60 provided on the shafts 32, 34 for suspension of the chute 30.

Referring to FIG. 2, the inert gas is admitted into the tank 50 through passages 62 provided in the plate 44. In order to permit the injection of the inert gas into the tank 50 under a predetermined pressure, with no risk of a substantial leak to the inside of the housing 42, the inside of the tank 50 comprises an annular seal 64 which is provided, on its inner and outer faces, with projecting ribs 66 designed to cooperate with the inner and outer surfaces of tank 50 so as to form a multiple labyrinth designed to create a substantial pressure loss so as to contain the gas in the tank 50 with no substantial leakage above its edges.

In order to improve the thermal capacity of the inert gas and to increase its cooling power, it is possible to inject into the gas, for example at the level of the annular tank 50 small quantities of water or water vapor.

Figure 3:
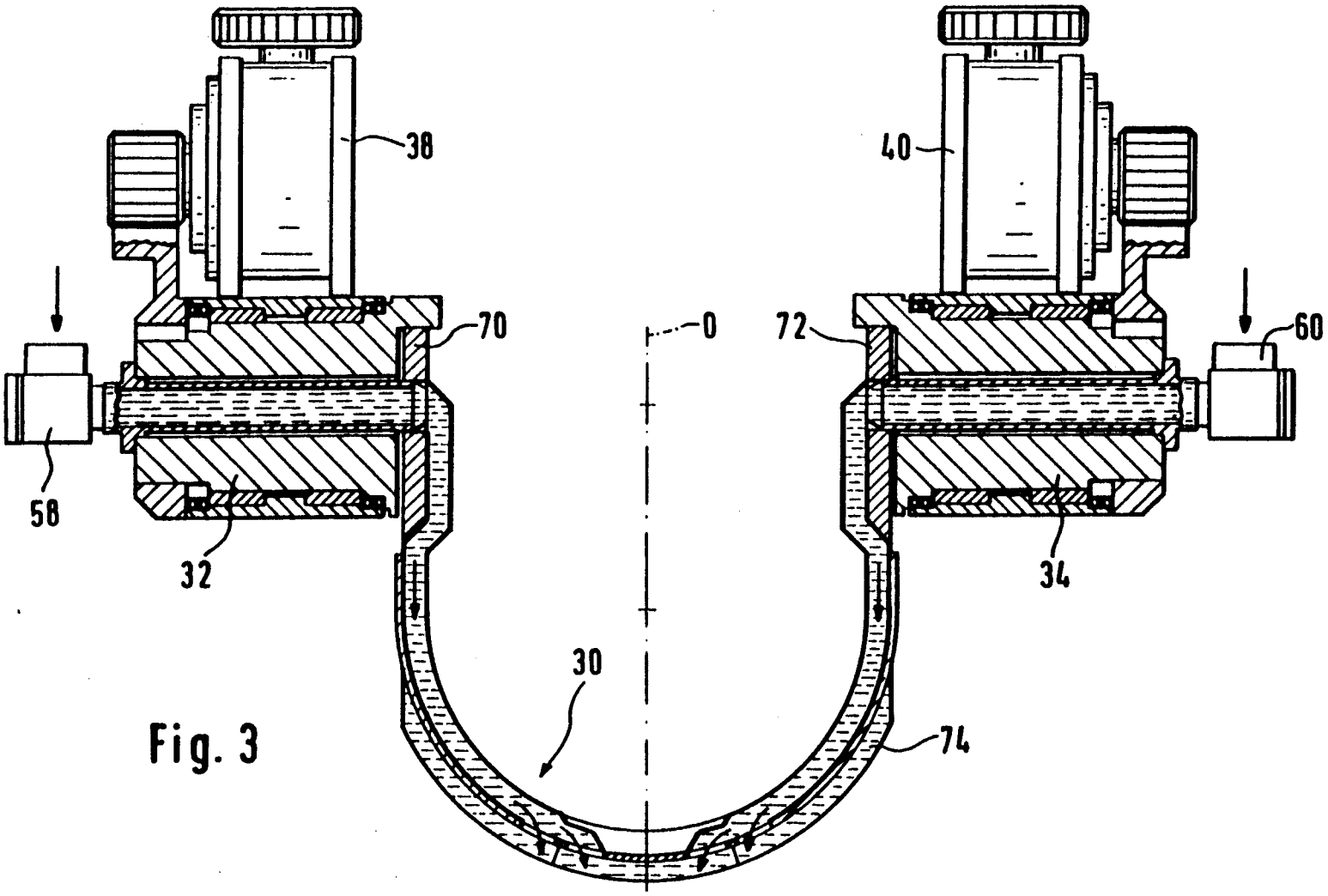
FIG. 3 shows diagrammatically a vertical cross-section through the suspension of the chute.
Figure 4:
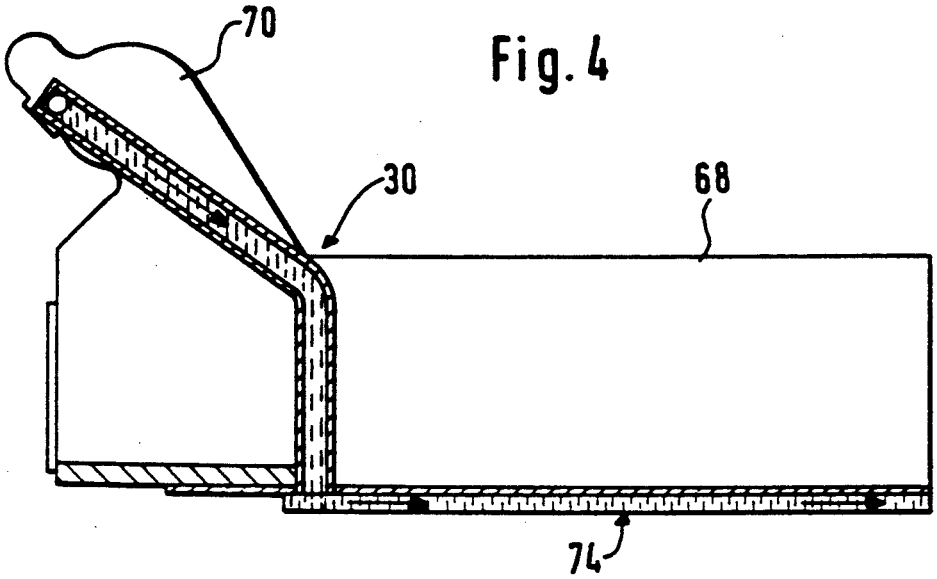
FIGS. 4 and 5 show the details of the chute cooling circuit.

FIG. 3 shows the details of the suspension of the chute 30 and of an example of a circuit for cooling by gas. The chute may be of the type described in U.K. Patent No. GB-1,487,527, in other words a semi-cylindrical body 68 lined internally with wear plates (now shown). As seen in FIG. 4, the body 68 comprises two lateral hooks 70, 72 of duckbill shape so that it can be hooked in a removable manner onto the suspension shafts 32 and 34 and be tipped by the latter about the horizontal axis.

Figure 5:
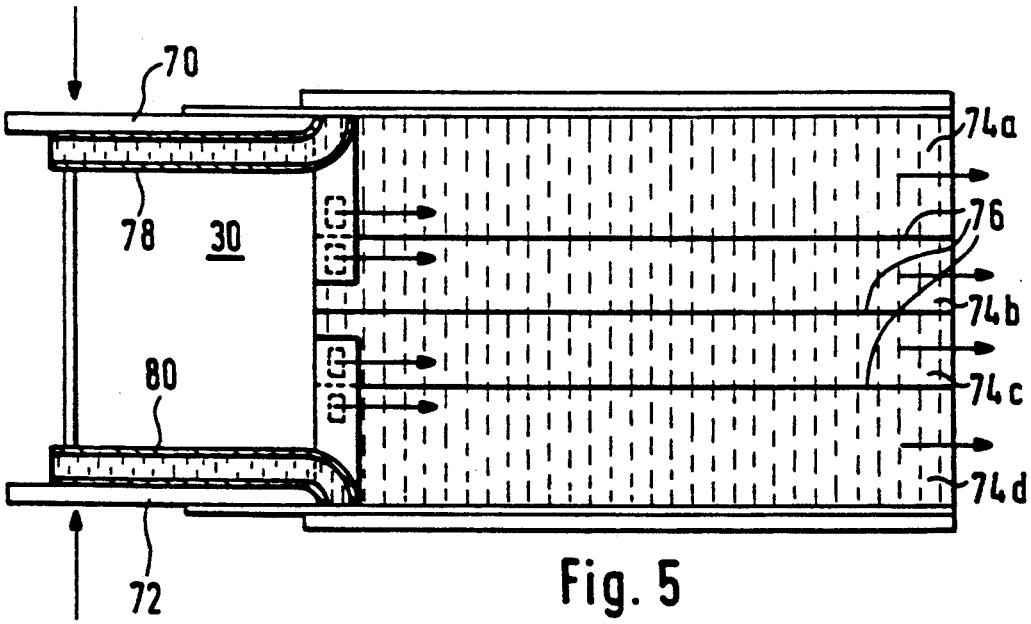

The lower part of the body 68 is lined by a jacket 74 defining a chamber for cooling the body 68. As seen in FIG. 5, this chamber 74 is, preferably, divided longitudinally, by partitions 76 into individual compartments 74*a*, 74*b*, 74*c*, 74*d* opening at the end of the chute 30 towards the inside of the furnace. Each of these compartments is fed by two pipes 78, 80 provided in the upper region of the chute 30 on the inner side of the body 68 and each comprising a circular section inside the body 68 and a longitudinal section along the hooks 70, 72 connected to passages running axially through the shafts 32 and 34 and connected to the rotary connectors 58, 60.

The system for cooling by inert gas is clearly shown diagrammatically in FIGS. 3 to 5 by means of arrows symbolizing the direction of flow of the gas. This system provides not only an effective cooling of the body 68 of the chute, but also a cooling of its suspension shafts. The gas leaving the chute 30 at its lower end can mix inside the furnace with the gas of the upper part of the furnace.

FIG. 6 shows diagrammatically a first embodiment of the passage of the gas through the suspension shaft 32. According to this embodiment, a pipe is mounted coaxially inside the shaft 32, to which it is securely attached, but from which it can be disengaged axially towards the left in the FIG. 6. On the inner side, this pipe 82 comprises a compensator 84 with bellows which bears resiliently, via a ring 85, against the outer edge of an aperture for passage into the hook 70 of the chute. This compensator 84 permits a certain freedom of movements between the chute and its suspension shaft 32, particularly in order to compensate for thermal deformations and production inaccuracies. The resilience of the compensator 84 provides, moreover, a sufficient leak-tightness between the hook 70 and the pipe 82, taking into account the fact that the pressure of the inert gas is not very high.

FIG. 7 shows another embodiment of a passage through a suspension shaft. According to the embodiment of FIG. 7, the mobility provided by the compensator 84 of FIG. 6 is replaced by a tube 86 having a thin, slightly deformable wall. This tube 86 is engaged coaxially through the shaft 32 so as to penetrate, with a sufficient degree of leak-tightness, into a corresponding aperture of the hook 70.

Figure 8:
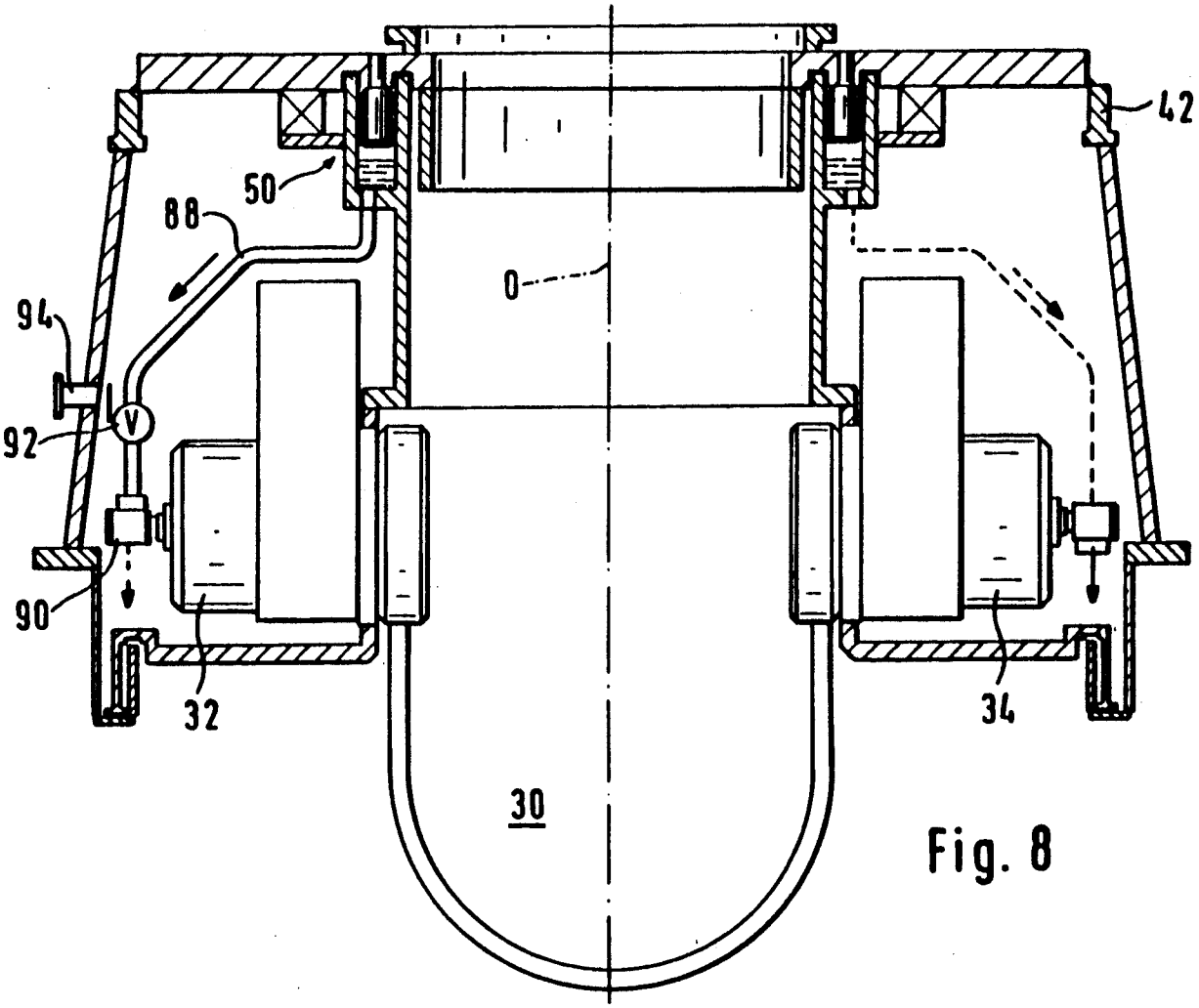
FIG. 8 shows diagrammatically a system for cooling a chute by water.

FIG. 8 shows an embodiment of a system for cooling the chute 30 with water through a circuit connecting the annular tank 50 to one or both of the suspension shafts of the chute, passing through coils of piping inside the latter. The suspension shaft 32 is connected to the tank 50 by a pipe 88 through a rotary connector 90. This pipe 88 preferably comprises a cock 92 so as to permit the closure of the cooling system when a water leak is found. This cock 92 may comprise a cock with pivoting lever which is actuated with the aid of a rod inserted through an aperture 94 in the housing 42, the closure being performed automatically by the rotation of the lever with the rotary cage about the vertical axis 0 of the furnace and under the effect of an overturning by the rod inserted through the aperture 94. This arrangement permits the cock to be actuated while maintaining the leak-tightness inside the housing with respect to the outside.

Figure 9:
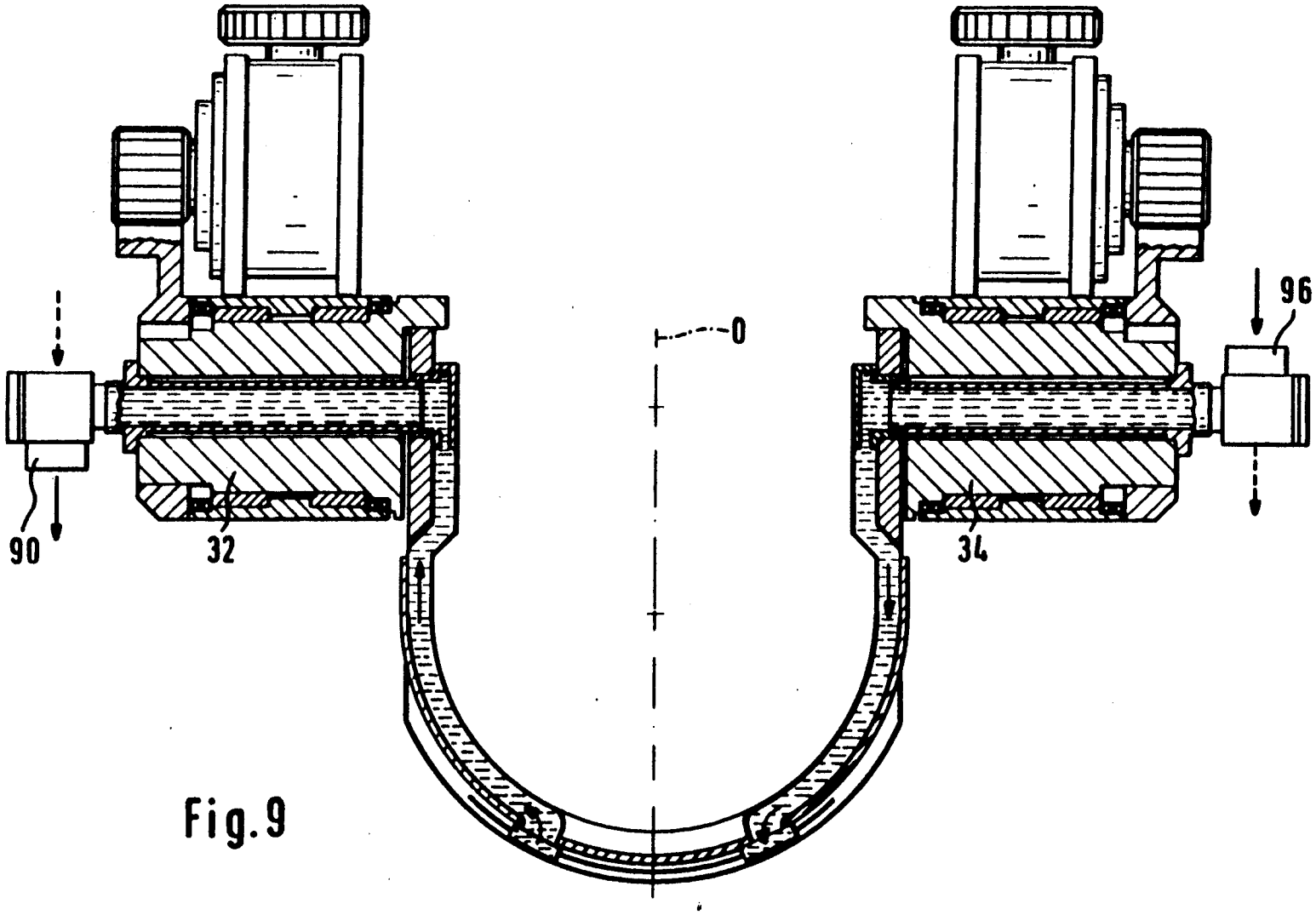
FIG. 9 shows diagrammatically a vertical cross-section through the suspension of the chute with a first embodiment of a circuit for cooling the chute.

In the embodiment shown in FIG. 9, the cooling water enters the circuit through one of the rotary connectors 96 and leaves via the other connector 90 after having passed through a circuit for cooling the chute. The cooling water leaving the rotary connector 90 falls back into a collector in accordance with the installation proposed in U.S. Pat. No. 4,526,536.

Figure 10:
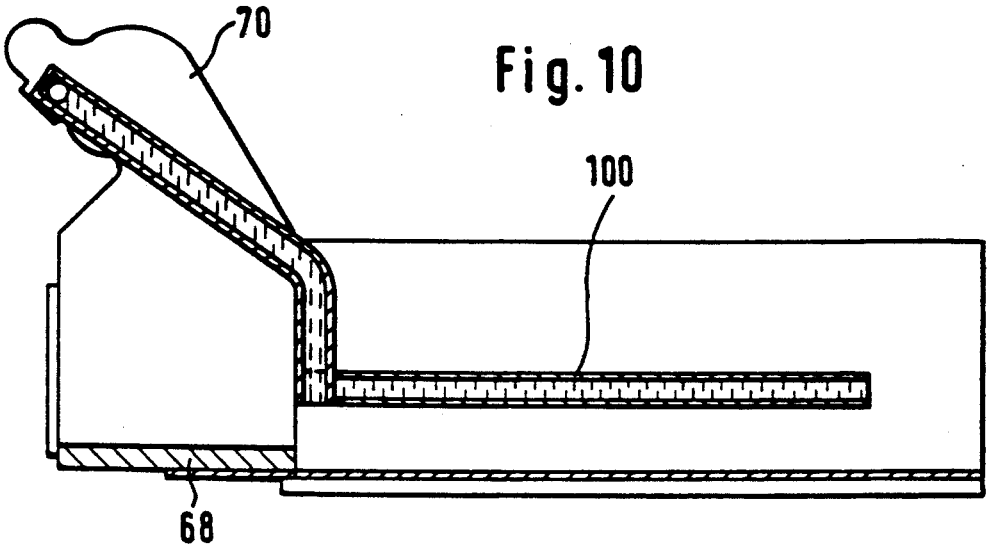
FIGS. 10 and 11 show diagrammatically the details of the first embodiment of the cooling circuit in the chute.
Figure 11:
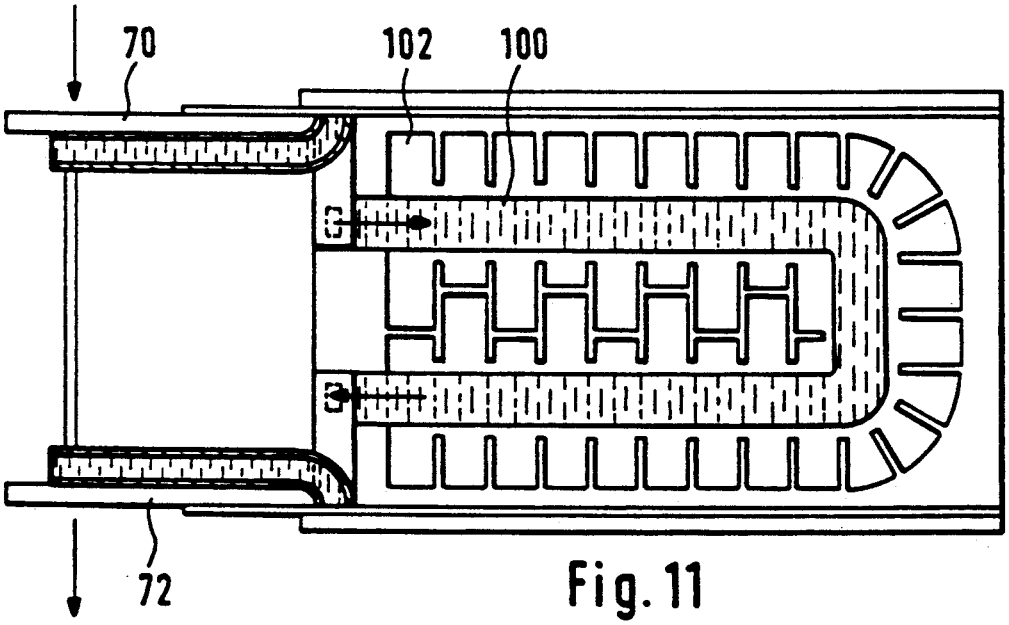

FIGS. 10 and 11 show a first embodiment of the cooling circuit of a chute 30 for a system according to FIG. 8. This cooling circuit comprises essentially a U-shaped coil of piping 100 the two branches of which extend longitudinally along the outside of the body 68 of the chute, on either side of the median axis. This Coil of piping 100 is connected by two pipes to the axes of the suspension shafts 32, 34 of the chute, the cooling water circulating in the direction shown by the arrows in FIGS. 9 and 11.

Figure 12:
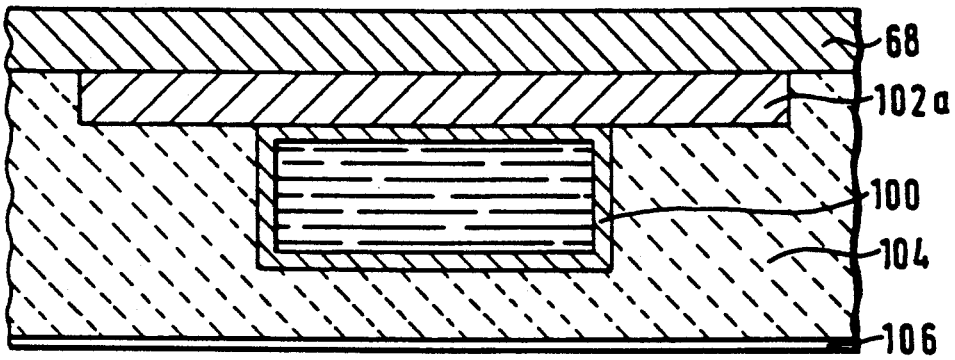
FIGS. 12, 13 and 14 show three variant arrangements of fins attached to the coil of piping for cooling.
Figure 13:
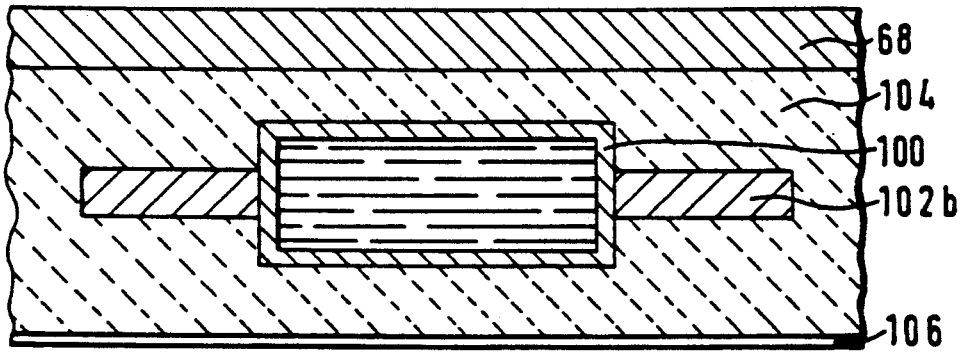
Figure 14:
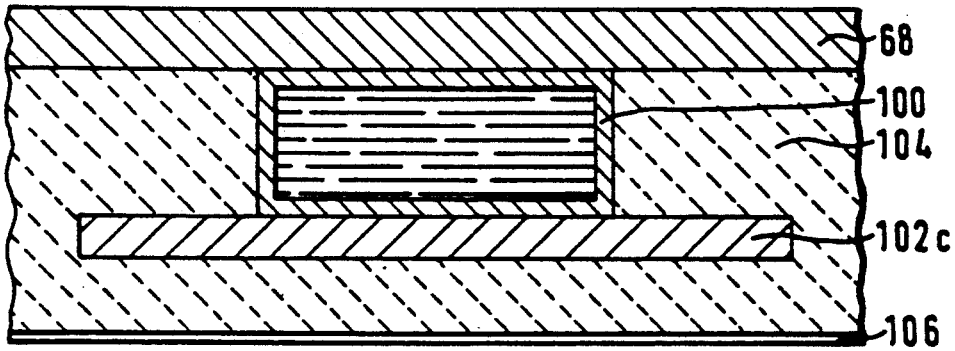

In order to improve the exchange of heat, this coil of piping 100 is provided, along its entire length and on each side with fins 102 of a material which is a good conductor of heat, such as copper. FIGS. 12 to 14 show various configurations or arrangements of these fins. Each of these FIGS. shows, in cross-section the coil of cooling piping 100 which runs through a refractory layer 104 provided around the outer surface of the body 68 inside a metal jacket 106. In the embodiment according to FIG. 12, the cooling fins 102*a* are disposed between the body 68 and the coil of piping 100 and are in direct contact with the body and the coil.

In the embodiment according to FIG. 13 the fins 102*b* extend into the mass of the refractory layer 104, approximately at the center of the thickness of the latter and are brazed on either side onto the coil of piping 100.

In the embodiment according to FIG. 14 the coil of piping 100 runs between the body 68 and the fins 102*c*, so as to form a thermal bridge between the fins, disposed on the side of the jacket 106 and the body 68.

Figure 15:
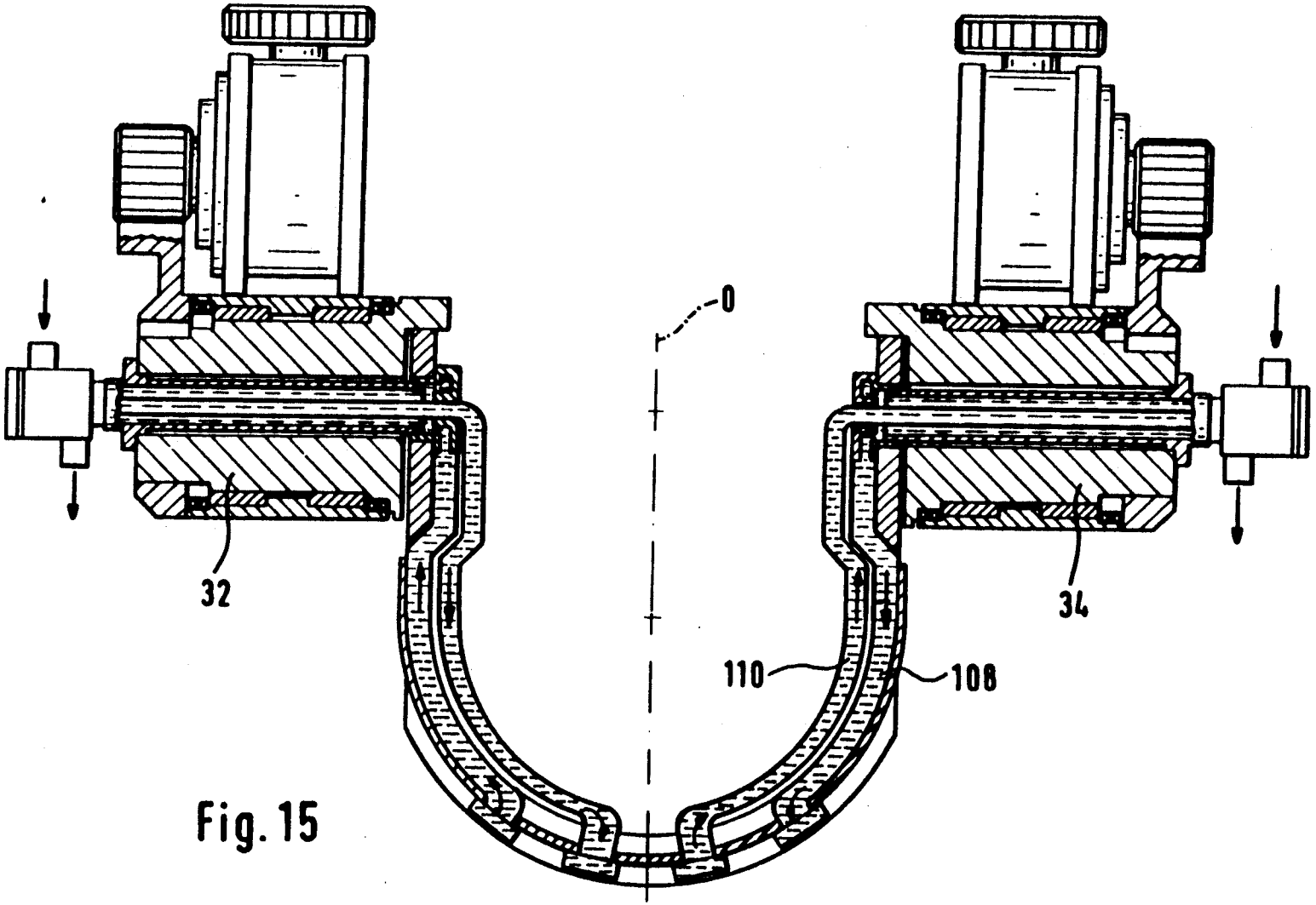
FIG. 15 shows diagrammatically a vertical cross-section through the suspension of the chute with a second embodiment of a system for cooling by water.
Figure 16:
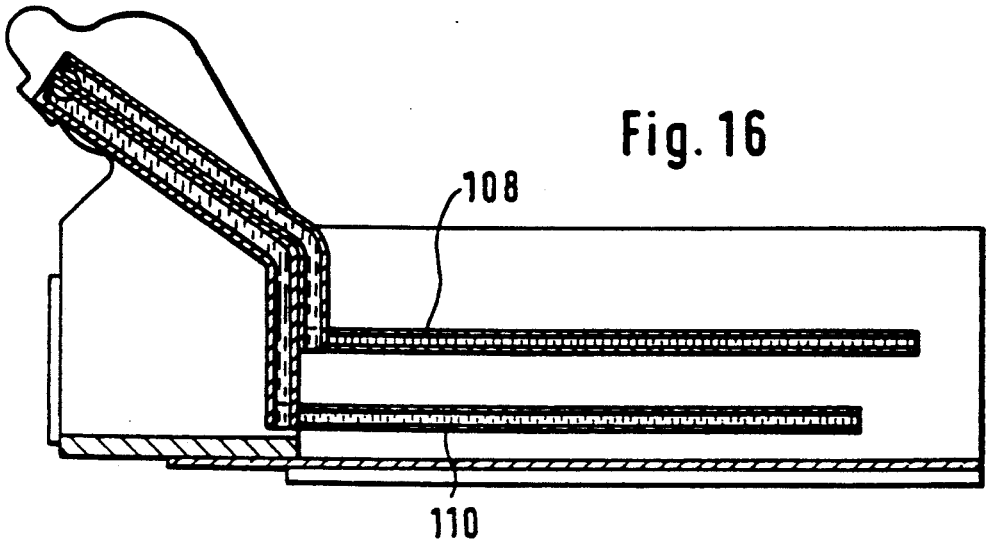
FIGS. 16 and 17 show diagrammatically the details of the cooling circuit of FIG. 15 in the chute.
Figure 17:
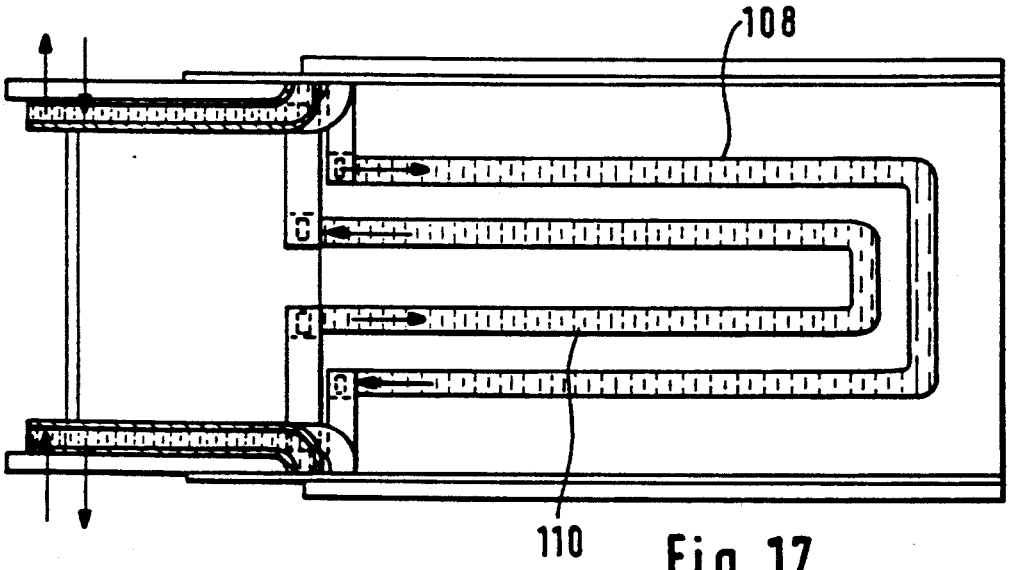

In the embodiment according to FIG. 11 it is obvious that, as a result of a single coil of piping, in one direction, the side of the chute served by the inlet to the circuit is better cooled than the opposite side through which the cooling water leaves the chute. FIGS. 15 to 17 show a second embodiment with a double cooling circuit providing a more uniform cooling of the chute 30.

As FIG. 17 shows in greater detail, this cooling circuit comprises two coils of piping 108, 110 both running in a U-shape in the longitudinal direction along the outer surface of the body, the coil 110 being disposed inside the two branches of the coil 108. The circulation through the coils of piping 108 and 110 is set up in the direction of circulation represented by the arrows, so that each of the branches served by an inlet of cooling water finds itself beside a branch through which the latter leave the circuit and vice versa, thus ensuring a more uniform cooling of the chute. Moreover, the presence of two coils of piping for cooling increases the density of cooling so that in this embodiment, even if it is possible it is not necessary to fit the coils of piping with cooling fins and to bury them in a refractory layer. However, the double cooling circuit necessitates the presence of double passages through the suspension shafts 32, 34.

These passages through the suspension shafts will now be described in greater detail with reference to the following FIGS., this both for the embodiment of FIG. 9 and for that of FIG. 15. FIG. 18 shows a first embodiment of such a passage for the single circuit according to FIG. 9. This circuit is formed by a tube 112 having a thin, slightly deformable wall extending coaxially through a passage of the suspension shaft 34, the opposite configuration through the shaft 32 being identical. The tube 112 is connected, on the outer side, directly to the rotary connector 96, and on the inner side is engaged coaxially in an aperture of the coil of piping 100 departing from the hook 72 of the chute, provided that a peripheral seal 114 is interposed. The thinness of the tube 112 and the connector sliding between the tube 112 and he inlet of the coil of piping 100 permit a certain degree of mobility, both in the axial direction, and in a direction perpendicular to the latter. It is obvious that the tube 112 must be capable of being easily disengaged towards the outside so as to permit removal of the chute.

FIG. 19 illustrates the principle of FIG. 18 applied to the embodiment of FIG. 15 with double coil of piping. According to this embodiment, two tubes 116 and 118 having thin, equally deformable walls are disposed coaxially one inside the other in the passage through the suspension shaft 34 and are connected, on the outer side, to a rotary double connector (not shown) and, on the inner side, are coaxially engaged, provided that peripheral circular seals are interposed, in apertures of the two coils of piping 108 and 110.

FIG. 20 shows another embodiment of a passage through the shaft 34 appropriate to the single cooling circuit of FIG. 9. According to this embodiment a rigid tube 120 passes coaxially through a passage through the shaft 34 and is connected, on the outside, to the rotary connector 96. On the inner side the tube 120 is connected via a compensator with bellows 122 to an annular seal 124 housed, at the level of the hook 72 of the chute, in a corresponding aperture of the coil of piping 100. The relative freedom of movement between the tube 120 and the chute is therefore provided by the compensator 122. An important feature of this embodiment is the presence of slots 126 in the tube 120 which permit the cooling water to circulate around the tube 120 and thereby to provide a better thermal contact with the shaft 34 compared with the embodiment of FIGS. 18 and 19 in which the exchange of heat is not so effective because of the space around the tubes 112 and 116. In the embodiment of FIG. 20 measures must of course be taken in order to insure a leak-tightness on the furnace side, which can be provided by an O-ring 128 provided around a flange of the tube 120.

FIG. 21 shows the principle of the device according to FIG. 20 applied to the double coil of piping of the cooling circuit of FIG. 15. A tube 130 corresponding precisely to the tube 120 of FIG. 20 passes coaxially through the shaft 34 and communicates, in leaktight manner, with the coil of piping 108. This tube permits the flow of the cooling water in contact with the shaft 34 and contributes to a better cooling of the latter. This tube 130 has, however, passing coaxially though it a second tube 132 permitting the cooling water to flow from the coil of piping 110 to which this tube is connected through the intermediary of a peripheral seal.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for cooling a distribution chute of an installation for charging a shaft furnace comprising a fixed channel for introduction of a material disposed vertically in about the center of the head of the furnace, a rotary collar mounted coaxially around the feed channel, a fixed outer housing mounted coaxially on the outside of the collar and delimiting laterally with the latter a substantially annular chamber, this chamber being separated from the inside of the furnace by means of a cage securely attached to the rotary collar, a distribution chute mounted in a pivoting manner in the rotary cage, driving means for causing the collar and the cage to turn, as one, about the vertical axis of the furnace and of the channel, two driving casings arranged diametrically opposed in the chamber and rotating with the rotary cage about the vertical axis, these casings acting on the suspension shafts of the chute so as to cause the pivoting of the latter about a horizontal axis, an annular feed tank attached on the upper edge of the rotary collar and whose outer and inner concentric walls slide in an upper fixed plate through which passes at least one pipe for admission of a cooling fluid feeding the annular tank, the device comprising:

a circuit for cooling a lower surface of a body of the distribution chute;

at least one pipe for connecting said circuit for cooling to the annular tank, said at least one pipe passing axially through the suspension shafts of the distribution chute; and rotary connectors having said at least one pipe passing therethrough.

2. The device of claim 1, wherein the cooling fluid comprises an inert gas.

3. The device of claim 1, wherein said circuit for cooling the distribution chute comprises:

a double wall enveloping the lower surface of the body of the distribution chute and divided by longitudinal partitions into individual compartments opening, at the end of the distribution chute towards the inside of the furnace.

4. The device of claim 1, further comprising:

an annular seal secured to the upper plate and penetrating inside the annular tank, said seal having outer and inner projecting ribs forming multiple labyrinths with the inner walls of the tank.

5. The device of claim 1, wherein said at least one pipe passing through the suspension shafts comprises:

a coaxial pipe securely attached to the shaft through which it passes but disengageable from the latter; and an intermediary comprising a compensator and a frontal seal for connecting said coaxial pipe to a side of the distribution chute.

6. The device of claim 1, wherein said at least one pipe passing through the suspension shafts comprises:

a thin slightly deformable pipe securely attached to the shaft through which it passes but disengageable from the latter and engaged in a corresponding aperture of the side of the distribution chute.

7. The device of claim 1, wherein the cooling fluid comprises water.

8. The device of claim 7, wherein the cooling water enters said circuit of the distribution chute through one of the suspension shafts of the distribution chute and leaves it through the opposite shaft.

9. The device of claim 8, wherein said cooling circuit comprises:

a U-shaped coil of piping disposed longitudinally in a refractory layer provided around the lower surface of the body of the distribution chute, inside a metal jacket.

10. The device of claim 9, wherein said coil of piping comprises:

a plurality of fins for the exchange of heat extending laterally on either side of the wall of said entire coil of piping in the mass of said refractory layer.

11. The device of claim 10, wherein said fins are in the direction of the thickness, between said coil of piping and the body of the distribution chute with which said coil and body make thermal contact.

12. The device of claim 10, wherein said fins are in the direction of the thickness, at about the middle of the said coil of piping and of said refractory layer.

13. The device of claim 10, wherein said fins are in the direction of the thickness, between said coil of piping and the jacket, said coil of piping being in thermal contact with the body and said fins.

14. The device of claim 7, wherein said circuit for cooling the distribution chute comprises:

two separate U-shaped coils of piping extending longitudinally under the body of the distribution chute; and two coaxial inlet and outlet passages through each of the suspension shafts, said two U-shaped coils of piping being connected to said coaxial inlet and outlet passages respectively.

15. The device of claim 14, wherein said two U-shaped coils of piping are arranged coaxially with respect to the median longitudinal axis of the body wherein the cooling water passes through said two U-shaped coils of piping in reverse direction.

16. The device of claim 9, wherein said at least one pipe passing through the suspension shafts comprises:

a coaxial pipe having a thin slightly deformable wall disengageable towards the outside; and an intermediary comprising circular seal for connecting said coaxial pipe to said coil of piping.

17. The device of claim 14, wherein said at least one pipe Passing through the suspension shafts comprises:

two coaxial pipes having thin slightly deformable walls; and an intermediary comprising circular seals for connecting said two coaxial pipes to the two coils of piping.

18. The device of claim 9, wherein said at least one pipe passing through the suspension shafts comprises:

a pipe having longitudinal slots for permitting outlet of the cooling water;

an intermediary comprising a compensator and a seal for connecting said pipe to said coil of piping of the distribution chute;

a leaktight chamber receptive to the cooling water from said longitudinal slots;

a tube around which said leaktight chamber is defined; and an O-ring for defining said leaktight chamber around said tube.

19. The device of claim 14, wherein said at least one pipe passing through the suspension shafts comprises:

a central tube connected to one of said coils of piping;

a second tube having said central tube passing coaxially therethrough, said second tube having longitudinal slots for permitting outlet of the cooling water;

an intermediary comprising a compensator and a seal for connecting said second tube to the other one of said coils of piping;

a chamber surrounding said second tube, said chamber being receptive to cooling water from said longitudinal slots; and an O-ring for closing off said chamber in a leaktight manner.

* * * * *